US005094055A

United States Patent [19]

Berdan

[11] Patent Number: 5,094,055

[45] Date of Patent: Mar. 10, 1992

[54] WINDOW GLASS SEAL

[76] Inventor: Gunter Berdan, 4 Bourbon St., Woodbridge, Ontario, Canada, L4L 6Y6

[21] Appl. No.: 521,639

[22] Filed: May 10, 1990

[30] Foreign Application Priority Data

Jun. 15, 1989 [CA] Canada ..... 602875

[51] Int. Cl.[5] ..... E06B 7/12

[52] U.S. Cl. ..... 52/397; 52/398; 52/788; 52/790

[58] Field of Search ..... 52/397, 398, 399, 402, 52/403, 788, 789, 790, 730, 731

[56] References Cited

U.S. PATENT DOCUMENTS

| | | | |
|---|---|---|---|
| 4,658,553 | 4/1987 | Shinagawa | 52/398 X |
| 4,850,175 | 7/1989 | Berdan | 52/788 X |

FOREIGN PATENT DOCUMENTS

| | | | |
|---|---|---|---|
| 2031812 | 12/1971 | Fed. Rep. of Germany | 52/399 |
| 2451988 | 11/1980 | France | 52/788 |
| 2464359 | 4/1981 | France | 52/397 |
| 2023209 | 12/1979 | United Kingdom | 52/790 |

*Primary Examiner*—Richard E. Chilcot, Jr.
*Assistant Examiner*—Wynn E. Wood
*Attorney, Agent, or Firm*—Caesar, Rivise, Bernstein, Cohen & Pokotilow, Ltd.

[57] ABSTRACT

A seal is provided for use in fabricating hermetically sealed multiple pane windows, by way of installation in sealing relation between a pair of adjacent window panes, the seal having a hollow section, generally of metal, of generally rectangular form having side portions for attachment to the respective adjoining window glass inner surfaces, a bottom sealing portion joining the two side portions of the section, the upper surface of the section having a gap therein serving as a thermal break between the two side portions, with a bridging member spanning the gap, being of low conductivity flexible material, generally plastic, to reinforce the section and forming therewith a perforated or perforable enclosure for desiccant material. A process and apparatus for manufacturing the seal is also disclosed, using roll forming to provide the hollow section, with gluing and heat curing of the joints attaching the low conductivity bridge piece to the section.

12 Claims, 4 Drawing Sheets

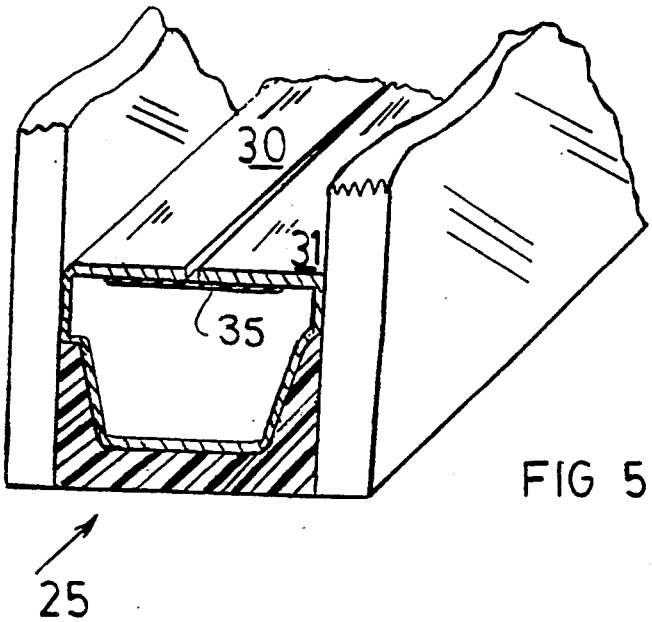
FIG 5
FIG 6
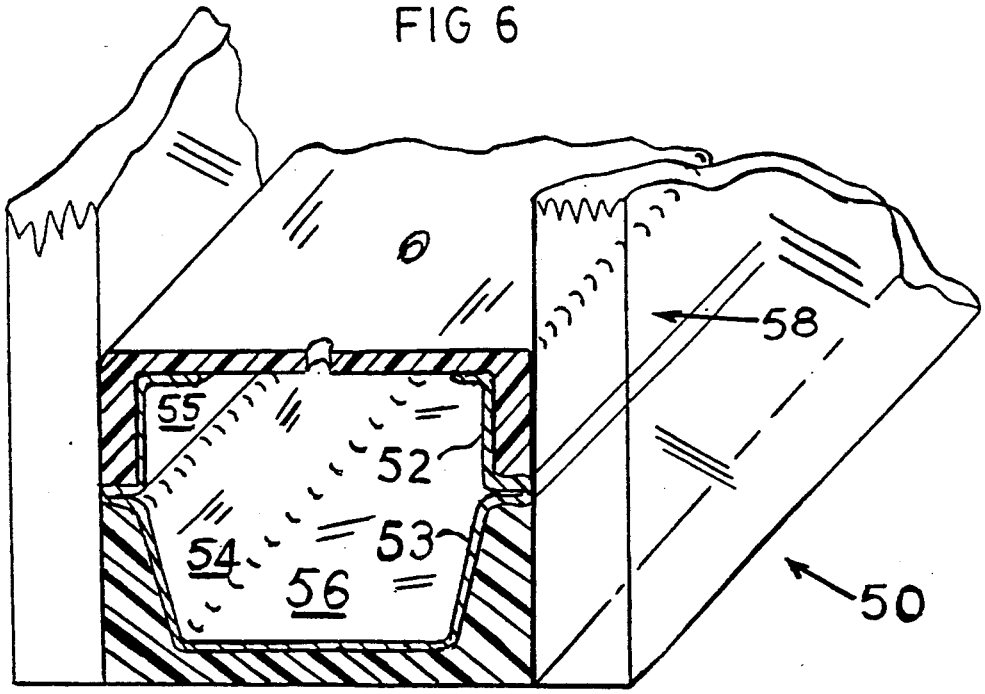

WINDOW GLASS SEAL

FIELD OF THE INVENTION

This invention is directed to separator spacers for use in sealing relation with hermetically sealed multi-glazed window units, and to a process and apparatus for the manufacture thereof.

BACKGROUND OF THE INVENTION

The manufacture of multiple glazed window units is a comparatively old and well developed art. It is commonplace to use aluminum and steel hollow spacers inserted in the interior of such windows in sealing relation between the opposed glass panes.

Plastic spacers, including pultruded fibreglass spacers are also known. However, many of the prior art constructions are expensive to manufacture, and many of the metallic ones provide a thermal bridge located on the innermost side of the seal and directly joining one glass inner face to the opposed glass inner face at an exposed location where a high thermal gradient exists. Under extremes of temperature that may be comparatively commonplace in northern areas of the United States, Canada, Scandinavia and Russia, with outside temperatures close to zero Fahrenheit and below, the effects of such thermal bridging may be to create a frost line along edge portions of the innermost pane adjacent the thermal bridge, to cause moisture precipitation or frost formation on the glass. Internal precipitation of moisture between the glass panes also can occur, which can lead ultimately to staining and discoloration of the glass, and of the peripheral seal, between the panes.

Certain aspects of the prior art are well illustrated by reference to prior patents, as follows:

U.K. Patent Application GB 2,077,834; Published Dec. 23, 1981, Albert. this illustrates a pair of hollow metallic sections in mutually nested, internally connected relation, the inner section being provided to abate noise transfer.

Canadian Patent 1, 008,307 Apr. 12, 1977, Berdan. This illustrates roll forming a hollow aluminum spacer section having a lip and groove joint on the innermost face thereof to aid flexibility.

U.S. Pat. No. 2,993,242, July 25, 1961, Leisibach. This illustrates the provision of metal spacer sections of H, U, T and other profile forms.

Germany: Offenlegungsschrift 2,730,264, Jan. 25, 1979, Jacobs. This illustrates various hollow tube sections and combined sections, with various plastic seals and separators.

U.S. Pat. No. 4,268,553, May 19, 1981, Marzouki et al. This shows a hollow rectangular section with rolled tongue and groove joint having a superposed plastic cap isolating the window space.

U.S. Pat. No. 4,222,213, Sept. 16, 1980, Kessler. This shows a hollow, generally rectangular metal section with a gapped inner flange and a plastic cap enclosing the top and sides of the section and protruding within the gapped flange of the section, as a perforated spacer.

U.S. Pat. No. 4,057,945, Nov. 15, 1977, Kessler. Similar to 213 above with the plastic cap forming two separate halves.

U.S. Pat. No. 4.113,905 Sept. 12, 1978, Kessler. This shows a hollow metal or plastic spacer with a foamed casing thereabout.

U.S. Pat. No. 3,971,178, July 27, 1976, Mazzoni et al. This shows a composite spacer with a gapped metal section containing a desiccant, with a communicating inner peripheral slot.

U.S. Pat. No. 4,658,553, Apr. 21, 1987, Shinagawa. This shows a thermoplastic hollow spacer section with a desiccant, and a communicating inner peripheral slot.

Other aspects of prior art seal constructions are shown in the following listed U.S. Pat. Nos.

U.S. Pat. No. 2,125,372 Aug. 2, 1938, Fox
U.S. Pat. No. 2,563,378 Aug. 7, 1951, Schnee
U.S. Pat. No. 2,838,809 June 17, 1958, Zeolla et al
U.S. Pat. No. 2,838,810 June 17, 1958, Englehart et al
U.S. Pat. No. 3,026,582 Mar. 27, 1962, Bayer
U.S. Pat. No. 3,261,139 July 19, 1966, Bond
U.S. Pat. No. 3,919,821 Nov. 18, 1975, Goetz
U.S. Pat. No. 4,171,601 Oct. 23, 1979, Gotz
U.S. Pat. No. 4,576,841 Mar. 1986, Lingemann The prior art is characterized by many spacer embodiments which serve as thermal bridges, or which suffer from drawbacks such as high cost, complexity, reliance for sealing on gas permeable materials, etc.

A further form of synthetic spacer comprises a "swiggle strip" as sold by the Tremco Corporation, having desiccant embedded therein. Desiccant activity in controlling humidity can be impaired and the installation of the soft, pliable spacer requires use of a special purpose machine.

SUMMARY OF THE INVENTION

In accordance with the present invention there is provided a spacer for use with a multi-glass window, the spacer having a hollow section culminating at the inner periphery thereof in a gap constituting a thermal break, having opposed edge portions thereof in mutually spaced apart relation, and a low thermal conduction bridging element in joining, section enclosing relation thereacross.

In a preferred embodiment an aluminum hollow spacer section having a continuous thermal break gap in the upper face thereof is provided with a polyester plastic, MYLAR (TM) ribbon in adhered relation to the uppermost face of the section.

It has been found that the provision of the adhered ribbon, of plastic or other suitable material while being substantially immaterial in a thermo-conductive sense, laterally contributes considerable strength to the aluminum section, while permitting a limited degree of section flexure, to accommodate the spacer more effectively to slight changes in the window glass under climatic extremes.

The tape cap also can serve to retain desiccant material within the section, while also facilitating intermittent puncturing of the tape at the gap, in gas and moisture transfer enabling relation with the interior of the section, such that desiccant within the section may be effective, without substantial impairment of the strength of the hollow section and tape combination. The ability to perforate the plastic tape to a desired limited extent makes possible the provision of holes of predetermined size for optimized performance, minimum desiccant percolation and with changed air flow characteristics as the structure breathes.

It will be understood that in virtually all installations the vertical orientation of the side seals, and the inverted orientation of the top seal enforce reliance upon the perforated plastic closure member to retain the desiccant particles within the section.

In a preferred embodiment a metal section is employed, in particular aluminum, the preferred plastic tape being of MYLAR (TM).

In one embodiment, the adhered tape cap extends only in adhering relation to the top, slot defining flanges. The application of a tape to the interior surfaces of the section top flanges also is contemplated.

A further embodiment comprises a tape cap overlay which also extends at least part way down the outsides of the hollow section, in adhered, wrapped relation thereto, as a profiled cap to provide an enhanced thermal break thereby.

The form, thickness and material for the overlaid dual-purpose, plastic cap and reinforcement can be varied, in order to achieve controlled stiffness, whereby the composite spacer section can be made stiff enough to withstand robust handling during production of the window seal section, and during incorporation thereof in the manufacture of windows, while remaining flexible enough to enable the window to "work" during thermal changes without undue stressing of the adhesive sealants securing the spacer to the adjoining glass surfaces.

A number of practical advantages accrue with the present spacer. Thus, it has been found that the achievable strength of the gapped section with an adhered MYLAR tape cap can exceed the strength of a corresponding all-aluminum closed section having a laser-welded top seam, The adoption of the tape and aluminum combined section permits the ready provision of a range of color schemes by selective color application such as blue, green and brown, for the plastic tape, thereby extending the color match options for a building architect. The present invention may be carried out as a continuous on line roll forming process, wherein the equipment costs associated with laser or other welding processes are avoided, and a comparatively low cost process can be employed.

The avoidance of a significant heat evolving process, such as induction welding also avoids the related need for coolants and the consequent necessity of subsequent cleaning and degreasing of the section. The improved spacer also provides the advantage of continuous side surfaces and bottom surfaces of the profiled aluminum spacer to form an excellent gas and moisture seal, and maintain good adhesion of the sealant between the glass surfaces and the spacer metal surfaces.

The present invention further provides a spacer manufacturing process wherein a metal spacer is roll-formed from a flat metal strip into a desired section configuration, through a series of rotating roller dies, followed by lamination of the reinforcement and insulating cap to the formed section, while stabilized within sizing rolls.

In carrying out the preferred process an incoming flat metallic strip is pre-heated to a predetermined extent as it is fed from the profile forming section, such that, on completion of the required stages of roll forming, with subsequent pre-heating of the section and the application of glue, followed by applying and pressing the cap into adhering relation to the laterally stabilized section, the adhesion of the tape to the metal of the section and curing of the joint will be sufficiently rapidly completed to enable positional and dimensional control thereof by section sizing rolls located within the laminating section.

Thus, there is provided a process for manufacturing a composite metal and tape product, comprising the steps of; forming a flat metal strip in coil form into a predetermined form of section having opposed spaced surfaces to form a thermal break therebetween; applying glue to predetermined surface portions of the product, and adhering a plastic cap of predetermined form in adherent reinforcing relation to the metal section by way of the glued surface, and curing the thus formed joint to laminate the plastic to the section.

In the preferred embodiment of the process the metal strip is pre-heated, subsequent to being roll formed to the desired cross section. Glue is applied to the selected surface or surfaces of the formed section, and spread to a predetermined extent by a glue spreader; a plastic cap is brought into contacting relation with the glued surface, and pressure applied thereto to effect permanent lamination of the tape to the section in predetermined reinforcement relation therewith while the section is laterally stabilized to a predetermined size.

The preferred cap of one embodiment comprises a plain tape of MYLAR plastic.

The process further includes perforating the tape over an opening in the section, to provide gas passage apertures of predetermined form, size and spacing in accessing relation with the interior of the section. This perforation is generally performed prior to the gluing attachment step but may if desired be performed subsequently to attachment.

Lateral stabilization of the formed section profile during the laminating process may be effected by the employment of sizing rolls, to preclude profile deformation due to heat and pressure effects.

The section subsequently has granular desiccant material inserted therein, prior to enclosure of the section as a completed frame, for installation in an multi-glass window.

Nylon corner pieces afford suitable joints for the system, and enable sealing of the frame to the joints and to the glass, in space enclosing relation.

Apparatus for carrying out the process comprises metal strip feeding means, forming rolls for forming the metal strip to a predetermined cross-section; glue applying means for applying a substantially uniform coating of glue over a predetermined surface area of the section; tape feeding means to feed tape in substantially synchronous relation with passage of the metal strip in forming relation through the forming rolls; tape guide means for guiding the tape into contacting adhering relation with the glue coating; and laminating roll means for laminating the tape to the section.

In the preferred embodiment the apparatus includes strip heating means, for pre-heating the profiled metal strip, to facilitate glueing, and to cure the thus formed joint; and tape perforating means, for perforating the tape cap, prior to its application.

In disclosing the present invention in relation to seals for windows it will be understood that such terminology applies also to doors, including patio doors, wherein the perimeter of adjacent sheets of glass may be hermetically sealed, internally, using a seal in accordance with the present invention.

BRIEF DESCRIPTION OF THE DRAWINGS

Certain embodiments of the prior art, and of the present invention are described by way of illustration, but without limitation of the present invention thereto, reference being made to the accompanying drawings, wherein;

FIG. 5 is a perspective view of a double glazed construction similar to the FIG. 2 embodiment, wherein the reinforcement tape is secured internally to the metal section;

FIG. 6 is a perspective view of a seal second embodiment in accordance with the present invention, incorporating an extruded thermal barrier and desiccant enclosure.

DETAILED DESCRIPTION OF THE INVENTION

Figure 1:
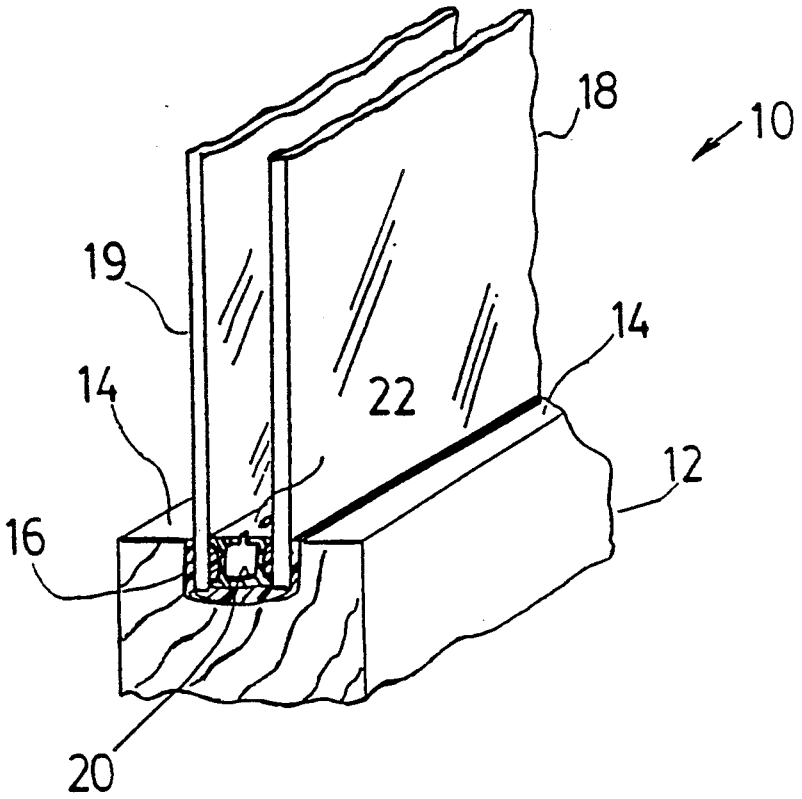
FIG 1 (PRIOR ART)
FIG. 1 is a perspective view of a portion of a double glazed construction of the prior art, which embodies a thermal bridging seal therein.

Referring to FIG. 1, the prior art arrangement 10 comprises a frame portion 12, the inner edge 14 of which is recessed at 16 to accommodate two sheets of glass 18, 19 and a hollow spacer 20 of aluminum. The spacer 20 has a perforated inner face 22 providing venting communication with the sealed space between the glasses 18.

A particulate desiccant material (not shown) is normally present in the hollow section 20, to control humidity in the enclosed window space, between the two glass sheets.

An elastomeric sealing material is interposed between all adjoining surfaces in sealing relation therewith. It will be seen that the perforated inner face 22 of spacer 20 is fully exposed to the thermal gradient extending from outer glass 18 to inner glass 19, and can serve as a thermal bridge therebetween, in the fashion described above, such that the surface of glass 19 can readily be cooled to the dewpoint of the room, so that condensation occurs there. At extremely low outside temperatures even frost can be generated on the inner glass 19.

Figure 2:
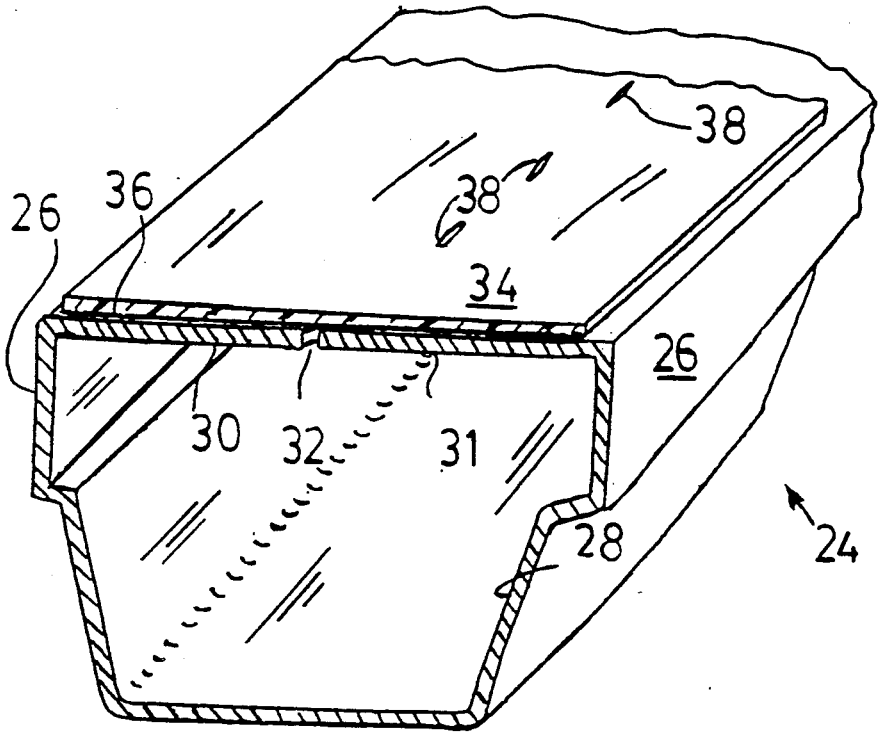
FIG. 2 is a perspective view of a seal first embodiment in accordance with the present invention, incorporating a plain reinforcement tape.

Referring to FIG. 2, a hollow section 24 in accordance with the invention is provided with a pair of side members 26 integrally joined by a bottom or outer seal portion 28.

Top inner seal portions 30, 31 have a gap 32 extending for the full length of the section 24, to form, a thermal barrier between the sides 26.

A closure cap 34 spans the gap 32, being adhered by way of a glued joint 36 to the adjacent top surfaces of seal portions 30, 31.

Perforations 38 in the cap 34 overlie the gap 32, and communicate with the interior of section 24 The perforations 38 may be of predetermined size and form, to afford a desired degree of "breathing" therethrough, such that desiccant material (not shown), within the section 24, can effectively serve the space lying above cap 34, which is enclosed between glass sheets, as in the fashion of FIG. 1.

Figure 4:
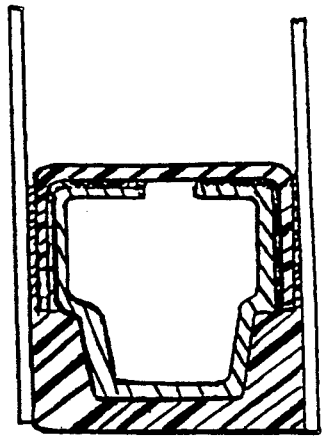
FIG. 4 is an end view of a seal in accordance with the present invention, embodying the reinforcement cap of FIG. 3, in assembled relation with two sheets of glass.
Figure 3:
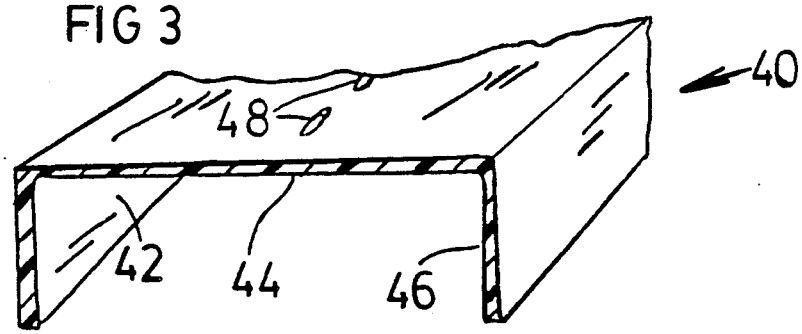
FIG. 3 is a perspective view of an inverted channel section plastic reinforcement cap.

Referring to FIG. 3, a cap 40 of inverted U-section has surfaces 42, 44, 46 for gluing and bonding to side surfaces 26 and the inner (top) surface of seal portions 30, 31 (FIGS. 2 and 4). Ventilation perforations 48 are aligned with the thermal break gap 32, for "breathing" access to the desiccant located in the interior of seal 24.

Referring to FIG. 5 it will be seen that gap 32 is spanned by an internally applied cap 35 which is bonded to the interior of section 25.

Referring to FIG. 6, the section 50 comprises a metallic portion with sides 52, 53, 54, 55 and bottom 56, of unitary construction, having a formed cap 58 of inverted U- form bonded in sealing relation therewith, and having interior ventilation perforations 60 therein.

The cap 58 may have a predetermined profiled cross-section in order to provide a desired degree of stiffness to the combined section 50, in lateral spacing relation between glass sheets.

Figure 7:
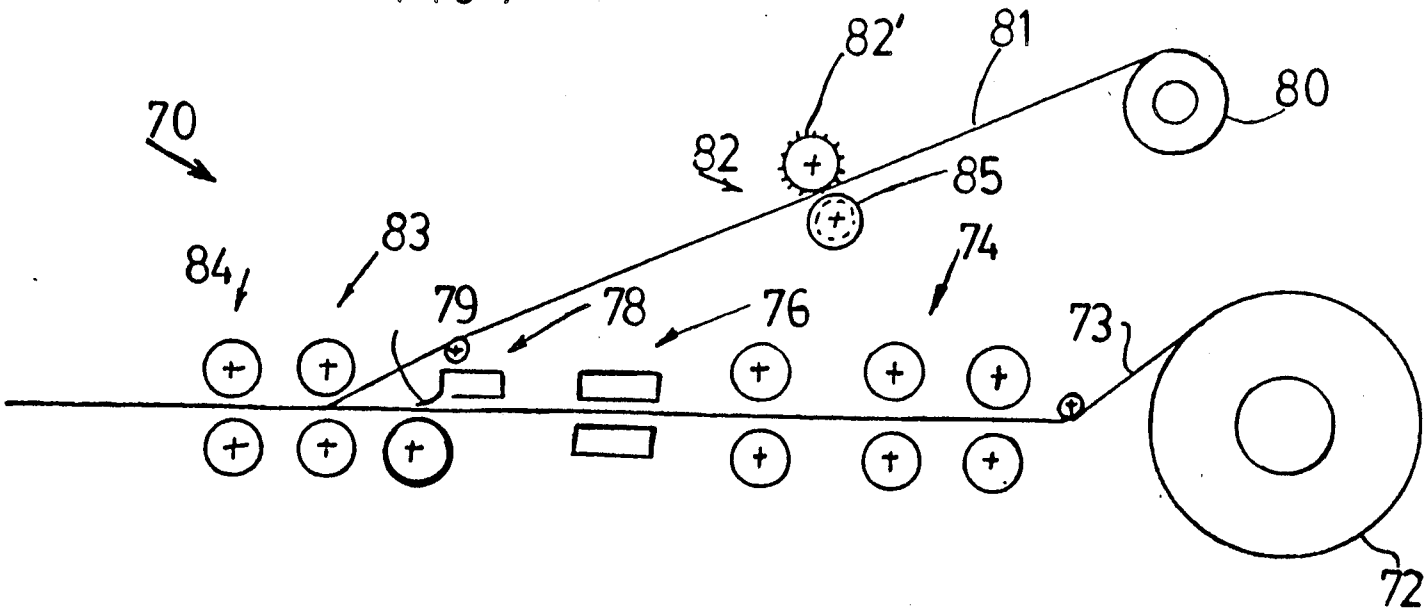
FIG. 7 is a schematic side elevation of an apparatus for manufacturing a seal, in accordance with the presently disclosed process.

The cap 58 may be formed from a suitable plastic tape, having a low coefficient of thermal conductivity, and suitable physical characteristics, such as Young's modulus (elasticity), and the capacity to be effectively glued. A plain MYLAR tape, as disclosed above, has been used successfully. Another material is extruded vinyl, wherein the extruded section is engineered to provide the desired characteristics. It is contemplated that a thin metallic ribbon also may he used as the cap materials, the thinness of the cap material rendering it as a poor thermal, bridge Referring to FIG. 7, a continuous process for manufacturing a seal in accordance with the present invention is carried out by apparatus 70.

A coil supply 72 of metal strip 73 is fed through a series of profile forming rolls 74 to a heating zone 76. The heating zone 76 may comprise infra red or quartz heating lamps, to preheat the strip 73.

A gluing station 78 applies a layer of a suitable glue on to predetermined areas of the profiled strip 73. A suitable spreader 79 and complementary support roll ensures a desired pattern and quantity of glue being applied.

A cap supply 80 provides a continuous supply of cap 81, illustrated as being a plain tape, suitable for the FIG. 2 and FIG. 4 embodiments, which is applied at station 83 to the glued surfaces.

A perforator 82 having an upper, perforating roll 82' and a complementary lower grooved roll 85 provide the cap 34, 40 with suitable perforations 38,48 of desired size, form and spacing. While not illustrated, it will be understood that in addition to perforator 82, the cap tape 81 may be formed in a desired inverted U-section or other shape, for application to the glued surface or surfaces of strip 73.

Laminating rolls 84 apply pressure to complete lamination of the cap 81 to the section.

The completed seal may be drawn onto a large diameter drum, or cut to lengths for packaging.

It will be understood that the present invention may be changed and modified, within the scope of the appended claims.

What is claimed:

1. A seal for use in fabricating hermetically sealed multi-layer windows by way of installation between a pair of adjacent window panes, the seal having a hollow metal section with side portions for attachment in sealing relation with respective adjoining inner surfaces of said panes an imperforate bottom sealing portion thereof extending in integral sealing relation with said side portions, mutually opposite upper portions of said section having a continuous gap therebetween serving as a thermal break between said side portions, and a bridging portion spanning the gap and bonded to said opposite upper portions in load transfer relation therebetween, comprising a low thermal conductivity plastic material of a form predetermined to reinforce the section laterally to provide the seal with desired structural characteristics.

2. The seal as set forth in claim 1, said bridging portion having apertures at predetermined intervals therethrough, overlying said gap, for access within said hollow section.

3. The seal as set forth in claim 2, said bridging portion comprising a planar plastic ribbon of predetermined width and thickness, secured in adhering relation to portions of top flanges of said section.

4. The seal as set forth in claim 3, said ribbon being attached to the exterior of said section.

5. The seal as set forth in claim 1, said bridging portion having a form profile, with downwardly extending edge portions thereof in adhering relation with said hollow section side portions.

6. The seal as est forth in claim 5, said bridging portion having apertures at predetermined longitudinal intervals extending therethrough, overlying said gap, for access within said hollow section.

7. The seal as set forth in claim 1, said hollow section side portions each including an inwardly offset wall portion to provide, in use, in cooperation with adjacent inner surfaces of said window a divergent seal zone extending about a lower portion of the seal, to receive an elastomeric sealant in injected relation therein.

8. The seal as set forth in claim 1, said hollow section side portions each including a laterally, outwardly extending rib portion, said bridging portion including downwardly extending edge portions secured to said side portions in overlying relation with said rib portions.

9. The seal as set forth in claim 8, said bridging portion being formed in inverted U-section from a plain ribbon.

10. The seal as set forth in claim 9, wherein said plain ribbon is of MYLAR plastic material.

11. The seal as set forth in claim 8, said bridging portion comprising an extruded plastic section having ann inverted U-shaped profile, wherein the legs of the U-shape are of predetermined thickness, relative to U-shape.

12. The seal as set forth in claim 11, said plastic section comprising a vinyl extrusion, wherein said legs thereof are thicker than said U-shape.

* * * * *